United States Patent [19]

Wolff

[11] Patent Number: 4,566,227

[45] Date of Patent: Jan. 28, 1986

[54] AUXILIARY DEVICE FOR RE-GRINDING OF SPIRAL DRILLS

[76] Inventor: Robert Wolff, Im Kiesacker 12, 5446 Engeln, Fed. Rep. of Germany

[21] Appl. No.: 625,236

[22] Filed: Jun. 27, 1984

[30] Foreign Application Priority Data

Oct. 27, 1983 [DE] Fed. Rep. of Germany ..... 3338910

[51] Int. Cl.[4] ..... B24B 19/00

[52] U.S. Cl. ..... 51/219 R; 51/219 PC; 51/221 R

[58] Field of Search ..... 51/219 R, 219 PC, 221 R

[56] References Cited

U.S. PATENT DOCUMENTS

| | | | |
|---|---|---|---|
| 201,449 | 3/1878 | Rider | 51/219 R |
| 388,784 | 8/1888 | Mossberg | 51/219 R |
| 2,408,544 | 10/1946 | Banner | 51/219 R |
| 2,730,849 | 1/1956 | Novak . | |
| 2,821,820 | 2/1958 | Thumann | 51/219 R |
| 3,121,983 | 2/1964 | English . | |
| 3,169,353 | 2/1965 | Krulwich | 51/219 R |
| 3,373,530 | 3/1968 | Cooprider | 51/219 R |
| 3,932,964 | 1/1976 | Simms . | |
| 3,961,450 | 6/1976 | Knaell . | |

FOREIGN PATENT DOCUMENTS

| | | | |
|---|---|---|---|
| 124857 | 7/1947 | Australia | 51/220 |
| 2456173 | 8/1976 | Fed. Rep. of Germany . | |
| 2632034 | 1/1978 | Fed. Rep. of Germany . | |
| 596950 | 3/1978 | Switzerland . | |
| 563546 | 8/1944 | United Kingdom . | |
| 575664 | 2/1946 | United Kingdom | 51/220 |

*Primary Examiner*—Frederick R. Schmidt
*Assistant Examiner*—J. T. Zatarga
*Attorney, Agent, or Firm*—Antonelli, Terry & Wands

[57] ABSTRACT

An auxiliary device for re-grinding spiral drills which includes a clamping channel for accommodating the spiral drill. The auxiliary device includes a polyhedronal shaped body which is adapted to be clamped onto the spiral drill. An outlet portion of the body is provided with at least one sight-edge running in parallel to a main cutting edge, with the sight-edge being several times longer than the main cutting edge. A bottom side of the body is formed as a supporting surface for supporting the same on a grinding table, with the supporting surface being inclined at a front clearance angle with respect to a longitudinal center axis of the drill. The body may be provided with two sight-edges at the outlet portion, with the sight-edges being inclined with respect to each other at an angle corresponding to a center angle of the drill. Additionally, the bottom as well as top side of the body may be fashioned as supporting surfaces set at the clearance angle with respect to the drill axis.

8 Claims, 5 Drawing Figures

AUXILIARY DEVICE FOR RE-GRINDING OF SPIRAL DRILLS

The present invention relates to a re-grinding tool an, more particularly, to an auxiliary device for re-grinding of spiral drills, which device includes a receiving channel for accommodating a spiral drill which is adapted to be disposed at a grinding disk for enabling a re-grinding of the drill.

In re-grinding of spiral drills, the main concern is the provision of two main cutting edges with exact pitch angles and clearance angles. While a number of auxiliary devices have been proposed which are capable of maintaining the complex and spatial angular relationships for re-grinding the spiral drills, a disadvantage of the proposed devices resides in the fact that they are not only too expensive but also too complicated to handle since they are always adapted to be stationarily fixed at a work bench or a work surface, and therefore the drill has to be mounted therein in a swivelling, sliding, shiftable or otherwise movable manner.

The aim underlying the present invention essentially resides in providing an auxiliary device for re-grinding spiral drills which enables an easy and safe handling while at the same time ensuring an exact re-grinding of the spiral drills.

In accordance with advantageous features of the present invention, an auxiliary device for re-grinding of spiral drills is provided which includes a hand operated body member having a polyhedronal configuration, which the body being adapted to be clamped onto a spiral drill. An outlet end of the body member, through which the drill bit extends, includes a sight-edge extending in parallel to a main cutting edge of the drill bit, with the sight-edge being several time longer than the main cutting edge. A bottom side of the body member, fashioned as a supporting surface for supporting the auxiliary device at a grinding table or the like, is set at a predetermined clearance angle with respect to the drill axis.

By virtue of the above noted features of the present invention, the auxiliary device can be freely controlled by hand after a fixing of the spiral drill. Thus, it is not necessary to provide additional tools or work elements for enabling a screwing, clamping, or adjusting of the drill bit, which represents a significant advantage of the auxiliary device of the present invention.

A further advantage of the present invention resides in the fact that, while it is almost impossible to maintain a direction of the main cutting edge with a free hand grinding of a spiral drill, by virtue of the provision of the long sight-edge of the auxiliary device, a good orientation of the auxiliary device and the spiral drill with respect to the grinding wheel is ensured. Moreover, by utilizing the lower supporting surfaces, the exact center angles can be maintained without any particular problems. Additionally, with the bottom side of the auxiliary device, fashioned as a supporting surface, by virtue of the inclination provided by the supporting surface, the clearance angle is always automatically adjusted independent of the skill and the sure eye of the user.

In accordance with further advantageous features of the present invention, the outlet end of the polyhedronal body through which the drill bit extends, can be roof-shaped and beveled in correspondence with a center angle of the drill, with a bottom side as well as the upper-side of the body member being formed as supporting surfaces set at the clearance angle with respect to the longitudinal center axis of the drill. By virtue of the double provision of the sight-edge and supporting surface, the handling of the auxiliary device is quite easy because after the grinding of the first main cutting edge, the drill in the auxiliary device does not need to be reset but rather a pivoting of the auxiliary device through 180° is enough to enable a re-grinding of the second main cutting edge of the drill in the same manner.

Advantageously, in accordance with the present invention, the polyhedronal body member may include two clamping jaws which are devided substantially along the drill accommodating channel. By virtue of the provision of the divided body member it is not necessary to provide for any special intricate clamping devices thereby resulting in the advantage that the body member may be easily manufactured as well as handled.

In accordance with still further features of the present invention, one of the clamping jaws includes a journal portion adapted to be slidably accommodated in the other clamping jaw, with the journal portion being provided with a passage for accommodating the drill as well as a tapered hole for accommodating a fixing or adjusting screw. Preferably, the fixing or adjusting screw extends from a side of the auxiliary device in order to provide ready access thereto thereby facilitating the clamping of the drill between the clamping jaws. Since the side of the auxiliary device does not come into contact with the grinding table, grinding disk or the like the head of the adjusting or fixing screw may be provided with a handle portion so as to facilitate an adjustment thereof. Moreover, with the adjusting screw extending from a side of the auxiliary device, it is possible to preserve the upper and lower surfaces of the body member as supporting surfaces.

According to the invention, both of the clamping jaws may be provided with guide means fashioned as form-closed interlocking guide lugs and adjoining hollow portions or chambers with the guide lugs and the chambers ensuring an exact guiding of both of the clamping jaws with respect to each other even though the body member is sub-divided. By virtue of these features, it is ensured that the supporting surface remain level, that is, the auxiliary device is free from tilting. The provision of the guide means are necessary since, due to the spiral form of the secondary cuttings, a slight displacement of both clamping jaws with respect to each other might occur when fixing a drill.

Alternatively, in accordance with the present invention, the polyhedronal body member may be made in one piece and include a cross channel for accommodating a clamping or fixing screw, with the cross channel terminating in the drill receiving channel. This constructional arrangement is especially very convenient from the manufacturing point of view. Advantageously, the fixing or adjusting screw is fashioned of a soft material or a plastic in order to avoid damaging of the drill.

The side surfaces of the body member may advantageously be used as guide surfaces cooperable with a guide stop or lug mounted on the grinding table. The use of the side surfaces of the body member as guide surfaces is advantageous if extreme standards for a precision of the center angle are set and especially if a plurality of drills have to be re-ground. In this connection, if a plurality of drills have to be re-ground, only one adjustment of the guide stop on the grinding table is necessary in order to always achieve an exact center angle.

Accordingly, it is an object of the present invention to provide an auxiliary device for enabling re-grinding of spiral drills which avoids, by simple means, shortcomings and disadvantages encountered in the prior art.

Another object of the present invention resides in providing an auxiliary device for enabling re-grinding of spiral drills which is simple in construction and therefore relatively inexpensive to manufacture.

A still further object of the present invention resides in providing an auxiliary device for enabling re-grinding of spiral drills which ensures a proper orientation of the spiral drills during a re-grinding operation.

Yet another object of the present invention resides in providing an auxiliary device for enabling a re-grinding of spiral drills which automatically adjusts a clearance angle with respect to an axis of the drill.

These and other objects, features, and advantages of the present invention will become more apparent from the following description when taken in connection with the accompanying drawings which show, for the purpose of illustration only, several embodiments in accordance with the present invention, and wherein.

Figure 1:
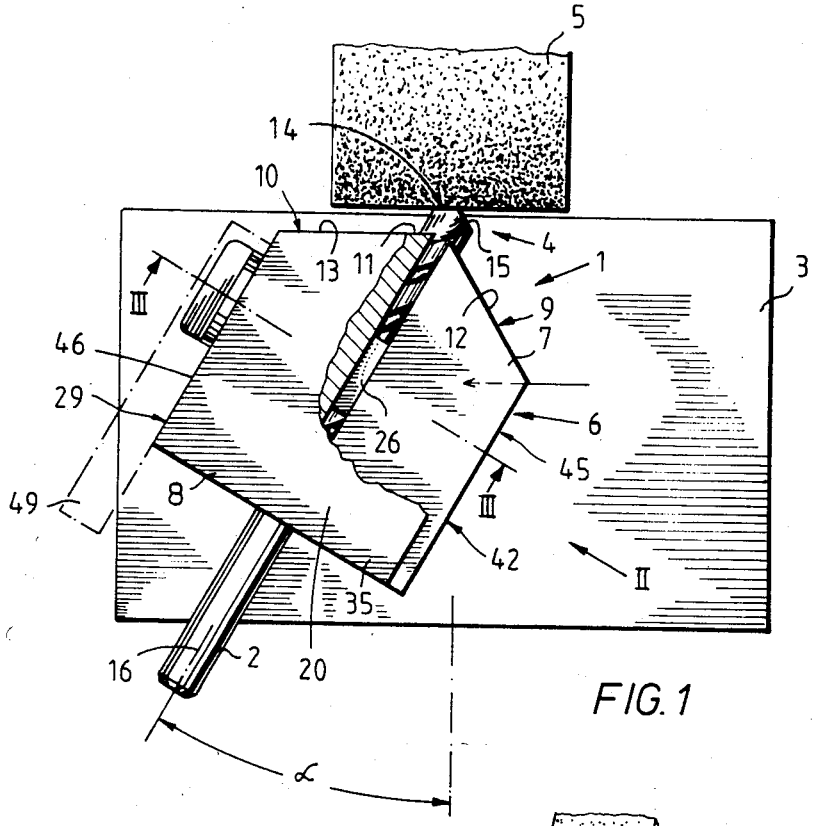
FIG. 1 is a top view of a first embodiment of an auxiliary device for re-grinding spiral drills constructed in accordance with the present invention mounted on a grinding table.

Referring now to the drawings wherein like reference numerals are used throughout the various views to designate like parts and, more particularly, to FIG. 1, according to this figure, an auxiliary device generally designated by the reference numeral 1 is adapted to rest or be mounted on a grinding table 3, with the auxiliary device 1 having a drill 2 insertable therein. The drill 1 includes a drill bit generally designated by the reference numeral generally designated by the reference numeral 4, with the drill bit 4 being adapted to be disposed in an outer peripheral area of a grinding disk 5. The auxiliary device 1 further includes a body member generally designated by the reference numeral 6 of a substantially polyhedronal configuration, with the body member 6 being formed of two clamping jaws 7, 8. The clamping jaws 7, 8 are provided with faces generally designated by the reference numerals 9, 10 at an outlet end 11 for the drill bit 4, with the faces 9, 10 being beveled and forming sight edges 12, 13, each of which extend in parallel to the main cutting edges 14, 15 of the drill bit 4. The sight-edges 12, 13 are beveled in such a manner that the drill axis 16 is advanced in a direction of the grinding disk 5 at an angle of $\alpha$ of preferably 30° thereby resulting in a normal center angle $\phi$ (FIG. 5) of 120° at the drill bit 4.

Figure 2:
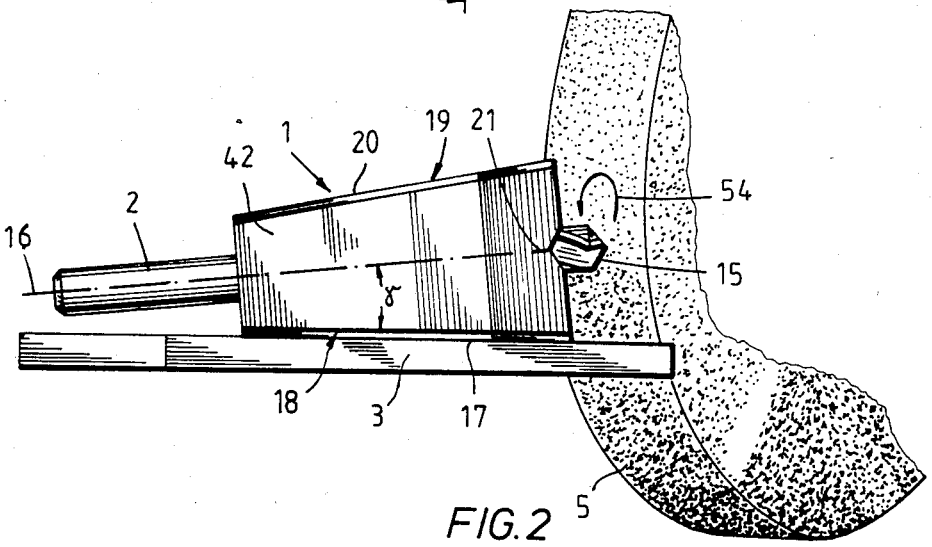
FIG. 2 is a perspective view taken in the direction of the arrow II in FIG. 1.

As shown most clearly in FIG. 2, a bottom side generally designated by the reference numeral 18 of the auxiliary device 1 is fashioned as a supporting surface 17 and is adapted to rest on the grinding table 3. The supporting surface 17 is set at a clearance angle $\delta$ with respect to the drill axis 16 so that the main cutting edge 14 gets a corresponding clearance angle $\delta$. In the illustrated embodiment of FIG. 2, the clearance angle $\delta$ is about 6° which is preferably primarily used for special cases as hard metal cutting edges or the like. However, other clearance angles are also possible. An upper side generally designated by the reference numeral 19 of the auxiliary device is also fashioned as a supporting surface 20 and in the same manner is set at the clearance angle $\delta$ with respect to the drill axis 16. Therefore, for a re-grinding of the main cutting edge 15, it is sufficient to turn the auxiliary device 1 through 180° and then to adjust the same in accordance with the sight edge 12. The exact clamping of the drill 2 in the auxiliary device 1 is facilitated by indicia or markings 21 onto which the main cutting edges 14, 15 are to be adjusted so as to achieve a proper horizontal orientation.

Figure 3:
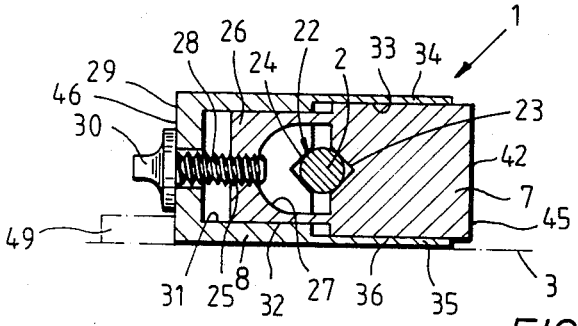
FIG. 3 is a cross-sectional view taken along the line III—III in FIG. 1.

As shown in FIG. 3, with a bipartite construction for the auxiliary device 1, the drill 2 is inserted into one drill receiving channel generally designated by the reference numeral 22 which is formed by two V-grooves 23, 24 respectively formed in the clamping jaws 7, 8. The clamping jaw 7 is provided with a clamping journal member 26 provided with a tapped hole 25 and an opening 27 for accommodating the drill 2. By a turning of an adjusting or fixing screw 28, the drill 2 is clamped in the receiving channel 22. Advantageously, the fixing screw 28 is provided with a handle 30 so as to enable a manipulation of the fixing screw 28 from a side of the auxiliary device 1.

The clamping jaw 8 is provided with an opening or chamber 31 for accommodating a journal member 26 of the clamping jaw 7, which journal member 26 includes a guide surface means 32 cooperable with a surface of the chamber 31 so as to accurately guide the clamping jaws 7, 8 and prevent any tilting of the clamping jaws 7, 8 with respect to each other during a clamping of the drill 2. If the auxiliary device 1 is formed of a soft material such as, for example, plastic, the clamping jaw 8 may be provided with additional wall portions 34, 35 surrounding the clamping jaw 7 so as to provide a further guide surface 33 cooperable with a guide surface 36 of the clamping jaw 7. Advantageously, the wall portions 34, 35 may form the planar supporting surfaces 17, 20 for the body member 6.

Figure 4:
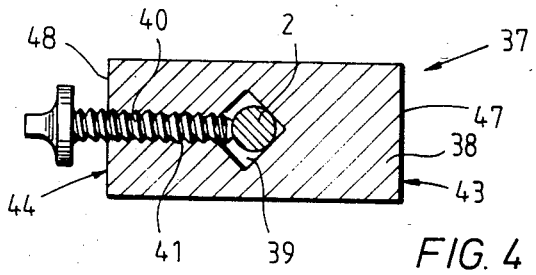
FIG. 4 is a cross-sectional view of another embodiment of an auxiliary device constructed in accordance with the present invention.

As shown in FIG. 4, an auxiliary device generally designated by the reference numeral 37 may be formed of a one piece polyhedronal body generally designated by the reference numeral 38, with the drill 2 being located in a rhombic shaped drill receiving channel 39 and clamped therein by a fixing or adjusting screw 40, threadably secured in a threaded cross bore or channel 41. In all other respects, the same geometric conditions for the body member 6 apply to the body member 38. However, for the correct function of the auxiliary device 37, it is of no importance if, due to smaller or bigger drill diameters, the drill axis 16 is located slightly eccentrically because, by virtue of the construction of the auxiliary device 37, the predetermined geometric conditions are still valid for the eccentrical case.

Advantageously, as shown in FIGS. 1 and 3, the respective side faces 29, 42 of the auxiliary device 1, and the respective side faces of the auxiliary device 36, generally designated by the reference numerals 43, 44 are constructed as guide surfaces 45, 46 or 47, 48 cooperable with a guide lug or stop 49 mounted on the grinding table. If a number of drills are to be re-ground, it is sufficient, prior to the carrying out of the grinding operation, to, for example, put the auxiliary device 1 with the face 10 thereof against grinding disk and to fix the guide stop 49 according to this orientation. Subsequently, all drills can then be exactly ground by simply placing the auxiliary device against the guide lug or stop 49.

Figure 5:
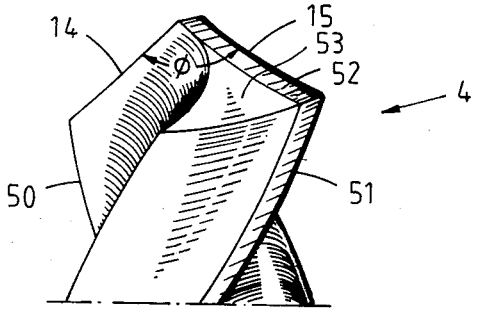
FIG. 5 is an enlarged perspective view of a drill bit.

FIG. 5 provides an illustration of a drill bit with the main cutting edges 14, 15 as well as the spiral shaped secondary cutting edges 50, 51 with the main cutting edges 14, 15 together forming a center angle $\phi$. A free surface 52 is located behind the main cutting edge 15, with the free surface 52 resulting from a partial grinding under the clearance angle $\delta$. While a drill with a diameter of less than 6 mm requires only a simple partial grinding under the clearance angle $\delta$, it is advantageous to provide an additional relief grinding surface 53 for bigger drill diameters. Additionally, this relief grinding surface 53 can be produces with the auxiliary devices 1 or 37 without any significant problems. After a first pass where the main cutting edges 14, 15 are partially ground under the clearance angle $\delta$ in the manner described above, the drill 2 is subsequently turned through about 15° in the receiving channel 22 or receiving channel 39 in a direction of the arrow 54 in FIG. 2 so that an orientation of the main cutting edges 14, 15 does not correspond to the indicia or marks 21. Another slight partial grinding results in the obtaining of the relief grinding surface 53.

While I have shown and described only one embodiment in accordance with the present invention, it is understood that the same is not limited there to but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An auxiliary device for re-grinding a spiral drill by a stationary grinding disc mounted with a horizontally rotating axis and by a horizontal grinding table, the spiral drill having a center angle inclined with respect to cutting edges thereof, the auxaillary device comprising a polyhedronal shaped body means, a channel means provided in said body means for accommodating the spiral drill, a pair of clamping jaws, means for clamping the spiral drill in the body means, said pair of clamping jaw means being divided substantially along said channel means, means for enabling the clamping jaws to be displaced towards and away from each other to respectively effect a clamping and a release of the spiral drill, two sight-edges for visually orienting the cutting edges of the spiral drill parallel to a grinding surface said sight edges being formed at an outlet end of said channel means and including an angle equal to the center angle, a bottom surface of the body means forms a supporting surface for supporting the body means on a grinding table at a predetermined front clearance angle with respect to a longitudinal center axis of the drill, whereby said center axis is inclined upwardly with respect to the outlet end of said channel means, a top surface forming a further supporting surface for supporting the body means in a position turned through 180° on the grinding table and inclined at a same but mirror inverted front clearance angle with respect to said center axis of the drill, one of said sight edges being on the top surface and the other sight edge being on the bottom surface of the body means, wherein for regrinding one of said cutting edges the body means is shifted with its bottom surface on the grinding table toward the grinding surface orthogonally to one of said sight edges, and wherein for regrinding the other cutting edge, the body means is turned upsidedown and shifted with the top surface lying on the grinding table towards the grinding surface orthogonally to the other one of said sight edges.

2. An auxiliary device according to claim 1, wherein said means for enabling the clamping jaw means to be displaced toward and away from each other includes a journal means provided on one of the clamping jaw means, said journal means being displaceably mounted in the other clamping jaw means, and wherein means are provided in the spiral journal means for accommodating the drill.

3. An auxiliary device according to claim 2, wherein the journal means includes a first guide surface means, said other clamping jaw includes a first guide surface means cooperable with said first guide surface means of the journal means for accurately guiding the displacement of the clamping jaw means.

4. An auxiliary device according to claim 3, wherein said journal means includes a second guide surface means axially spaced from said first guide surface means of said journal means, said other clamping jaw means including wall means surrounding said second guide surface means and defining a further guide surface means cooperable with said second guide surface means for accurately guiding the displacement of the clamping jaw means.

5. An auxiliary device according to claim 1, wherein said body means is formed as a one piece member, and wherein said means for clamping the drill includes a threaded cross channel means for accommodating a clamping member, said cross channel means communicating with said channel means accommodating the spiral drill so as to enable the drill to be clamped in position by said clamping member.

6. An auxiliary device according to claim 5, wherein said body means includes side faces adapted to cooperate with a guide means provided on the grinding table.

7. An auxiliary device according to claim 1, wherein said body means includes side faces adapted to cooperate with a guide means provided on the grinding table.

8. An auxiliary device for regrinding a spiral drill by a stationary grinding disc mounted with horizontally rotating axis and by a horizontal grinding table, the spiral drill having a center angle inclined with respect to cutting edges thereof, the auxiliary device being formed of a freely movable spiral holder means comprising: a polyhedronal shaped body means including a channel means provided in said body means for accommodating the spiral drill, two sight edges for visually orienting the cutting edges parallel to a grinding surface, said sight edges being formed at an outlet end of said channel means and including an angle equal to the center angle, a bottom surface forming a supporting surface for supporting the body means on the grinding table at a predetermined front clearance angle with respect to a longitudinal center axis of the drill, whereby said center axis is inclined upwardly with respect to the outlet end of said channel means, a top surface forming a further supporting surface for supporting the body means in a position turned through 180° on the grinding table and inclined at a same but mirror inverted front clearance angle with respect to said center axis of the drill, one of said sight edges being on the top surface and the other sight edge being on the bottom surface of the body means, wherein, for regrinding one of said cutting edges, the body means is shifted with its bottom surface on the grinding table toward the grinding surface orthogonally to one of said side edges, and wherein for regrinding the other cutting edge the body means is turned upside down and shifted with its top surface lying on the grinding table toward the grinding surface orthogonally to the other end of said sight edges.

* * * * *